US008928238B2

(12) United States Patent
O'Neil

(10) Patent No.: US 8,928,238 B2
(45) Date of Patent: Jan. 6, 2015

(54) SUPPLEMENTAL DIMMING CIRCUIT FOR ELECTRONIC LED DRIVER

(75) Inventor: Thomas O'Neil, Torrance, CA (US)

(73) Assignee: Eptronics, Inc., Gardena, CA (US)

( * ) Notice: Subject to any disclaimer, the term of this patent is extended or adjusted under 35 U.S.C. 154(b) by 630 days.

(21) Appl. No.: 13/345,498

(22) Filed: Jan. 6, 2012

(65) Prior Publication Data

US 2013/0175940 A1 Jul. 11, 2013

(51) Int. Cl.
*H05B 37/02* (2006.01)
*H05B 39/04* (2006.01)

(52) U.S. Cl.
USPC ..... 315/224; 315/291; 315/299; 315/301; 315/311

(58) Field of Classification Search
None
See application file for complete search history.

(56) References Cited

U.S. PATENT DOCUMENTS 8,723,439 B2 * 5/2014 Leung et al. ..... 315/247
2011/0309759 A1 * 12/2011 Shteynberg et al. ..... 315/201

* cited by examiner

*Primary Examiner* — Anh Tran
(74) *Attorney, Agent, or Firm* — Clement Cheng

(57) ABSTRACT

A supplemental dimming circuit for an electronic led driver comprising a universal control section has a VCC3 startup and low conduction period circuit for providing a current during start-up and during low conduction periods; a CC hold current circuit for providing a hold current for the dimmer at low conduction periods; a latch circuit for providing a current draw latch on; and a PWM synchronized dimming circuit for providing a PWM signal dependent on the conduction period of the dimmer in real time. The supplemental dimming circuit also has a socket and a plug. The universal control section is on a daughter board that is pluggable to the socket. The VCC3 startup and low conduction period circuit creates a low AC voltage dummy load, which is a resistive load. The CC hold current circuit creates a low AC current dummy load that is a constant current load.

16 Claims, 6 Drawing Sheets

SUPPLEMENTAL DIMMING CIRCUIT FOR ELECTRONIC LED DRIVER

FIELD OF THE INVENTION

The present invention is in the field of supplemental forward phase or reverse phase a dimming circuit for an electronic LED driver.

DISCUSSION OF RELATED ART

Traditionally, incandescent lights have had dimmer control for dimming by lowering voltage. Typically, the LED control is installed along with the electronic LED driver and the traditional dimmer control is removed. Today, many LED lamps are being installed and users may want to keep the traditional dimmer control for architectural reasons or for ease of installation.

A variety of different related art may provide a reference for understanding the nature of this general technology. Janczak in U.S. Pat. No. 6,175,195 issued Jan. 16, 2001 provides a TRIAC dimmable compact fluorescent lamp where a dimming interface is described, the disclosure of which is incorporated herein by reference. Takita in U.S. Pat. No. 6,304,465, the disclosure of which is incorporated herein by reference, issued Oct. 16, 2001 describes in the abstract: A power regulator including a coil connected to an output of a DC power source for rectifying an AC voltage, a charge-and-discharge capacitor for charging a current supplied from the DC power source through the coil and a backflow preventing diode, a switching device connected to a connection point of the coil and backflow preventing diode in parallel with the DC power source, and a microcomputer for detecting a zero-cross point of the magnetic field energy generated in the coil or the current flowing through the coil, and for bringing the switching device into conduction in response to the detection of the zero-cross point.

Brown in U.S. Pat. No. 7,102,902 provides a dimmer circuit for LED. The dimmer circuit applies load to the TRIAC when AC voltage is low, but not in other situations such as if the AC current is low. The dimmer circuit provides a constant resistive load to AC when voltage is low. Also, the dimmer circuit does not mention a pluggable application.

Elliott in U.S. Pat. No. 7,126,290 provides a light dimmer for incandescent and LED lamps and discusses a method to use PWM voltage overlapped with DC voltage to control LED brightness. Bourgault in U.S. Pat. No. 7,333,027 provides a power supply for LED signal which uses circuit to dim LEDs.

Kohler in U.S. Pat. No. 7,609,008 issued Oct. 27, 2009 describes in the abstract: A control circuit coupled to a power line controlled by a dimmer having a switching device includes, for example, an active power factor correction circuit receiving power from a bridge rectifier and storage capacitor and drawing an average continuous current when the switching device is "on." An LED power driving circuit receives a controlled current from the active power factor correction circuit and generates an output current received by at least one LED outputting visible light. A positive voltage feedback circuit senses a feedback voltage across the LED, through the LED power driving circuit, and sends the feedback voltage to the active power factor correction circuit. A pump back power circuit is electrically coupled to the LED power driving circuit and applies a bias voltage to an output of the bridge rectifier to power the active power factor correction circuit when the switching device is "off"

Scianna in U.S. Pat. No. 7,872,427 issued Oct. 27, 2009 to Scianna and provides a dynamic dummy load to allow a phase control dimmer to be used with LED lighting which describes in the abstract: The invention disclosed herein is a dynamic dummy load to allow a phase control dimmer to be used with LED lighting. The invention includes providing a dynamic dummy load to provide a load to the dimmer when the LED electronics do not provide sufficient load due to start up issues or ringing in the circuit, the dynamic dummy load providing a reduced flow of current when the LED and its converter electronics provide sufficient current draw from the dimmer. The system generally includes a power source electrically connected to a phase control dimmer, the phase control dimmer electrically connected to converter circuitry to convert the AC power output of the dimmer to DC power output for powering the LED lighting, a dynamic dummy load electrically connected in parallel with the converter circuitry, the dummy load varying its current draw in response to operation of the converter circuitry. Scianna is incorporated herein by reference.

SUMMARY OF THE INVENTION

A supplemental dimming circuit for an electronic led driver comprising a universal control section has a VCC3 startup and low conduction period circuit for providing a current during start-up and during low conduction periods; a CC hold current circuit for providing a hold current for the dimmer at low conduction periods; a latch circuit for providing a current draw latch on; and a PWM synchronized dimming circuit for providing a PWM signal dependent on the conduction period of the dimmer in real time.

The supplemental dimming circuit also has a socket and a plug. The universal control section is on a daughter board that is pluggable to the socket. The VCC3 startup and low conduction period circuit creates a low AC voltage dummy load, which is a resistive load. The CC hold current circuit creates a low AC current dummy load that is a constant current load.

The supplemental dimming circuit also may have a VCC startup and low conduction period source circuit. The supplemental dimming circuit preferably has a socket and a plug, wherein the universal control section is on a daughter board that is pluggable to the socket.

The supplemental dimming circuit may also have a VCC3 Normal run 15V circuit and a VCC startup and low conduction period source circuit.

The following call out list of elements references call out numbers of the drawings.

10 AC Filter and Conversion Circuit
11 Forward Phase or Reverse Phase Dimmer
20 Dimmer Latch and Hold Circuit
21 Universal Control Section
22 CC Hold Current Circuit
23 Latch Circuit
24 VCC3 Startup and Low Conduction Period Circuit

25 PWM Synchronize Dimming Circuit
26 VCC Startup and Low Conduction Period Source Circuit
27 VCC3 Normal Run 15V Circuit
30 Synchronize Dimming Circuit
40 Primary Controller
50 Transformer
60 Isolated Feedback
70 Isolated Feed Through
80 SEC Feedback Controller
90 LED Driver Output
100 Pluggable Board
110 Socket
115 Daughter Card

DETAILED DESCRIPTION OF THE PREFERRED EMBODIMENT

Figure 2:
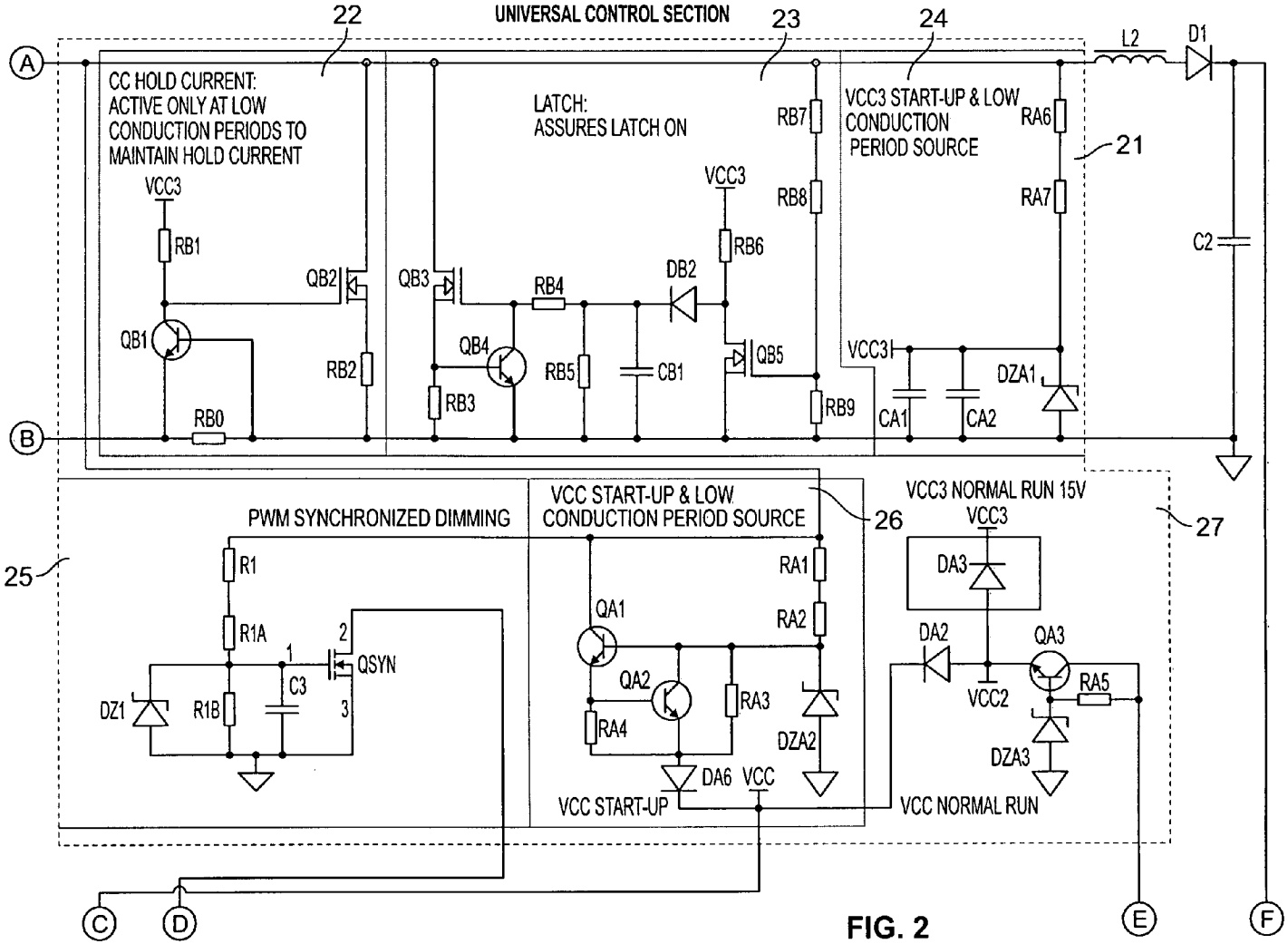
FIG. 2 is a diagram of the Universal Control Section.
Figure 3:
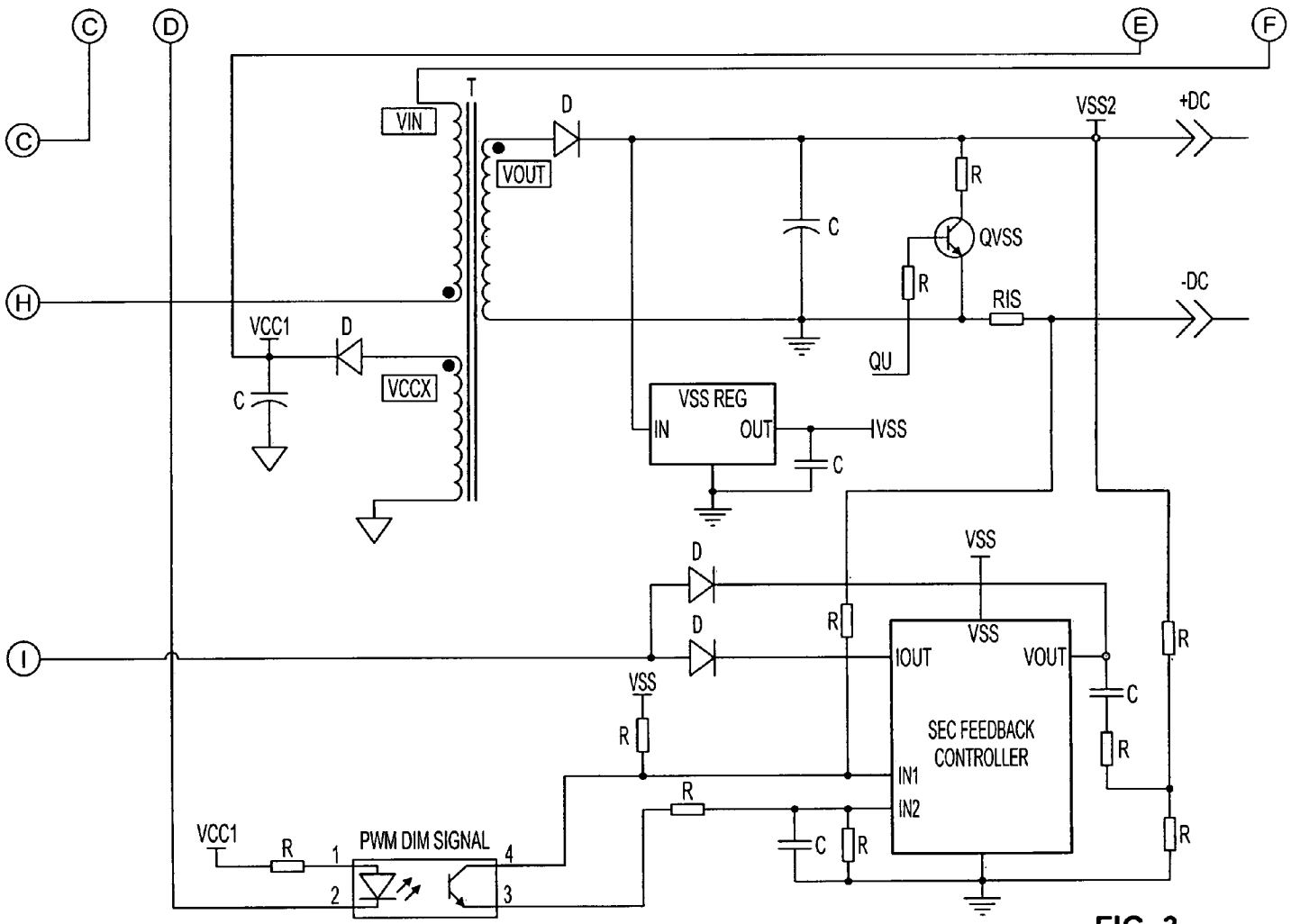
FIG. 3 is a circuit diagram of an auxiliary portion of the circuit.
Figure 4:
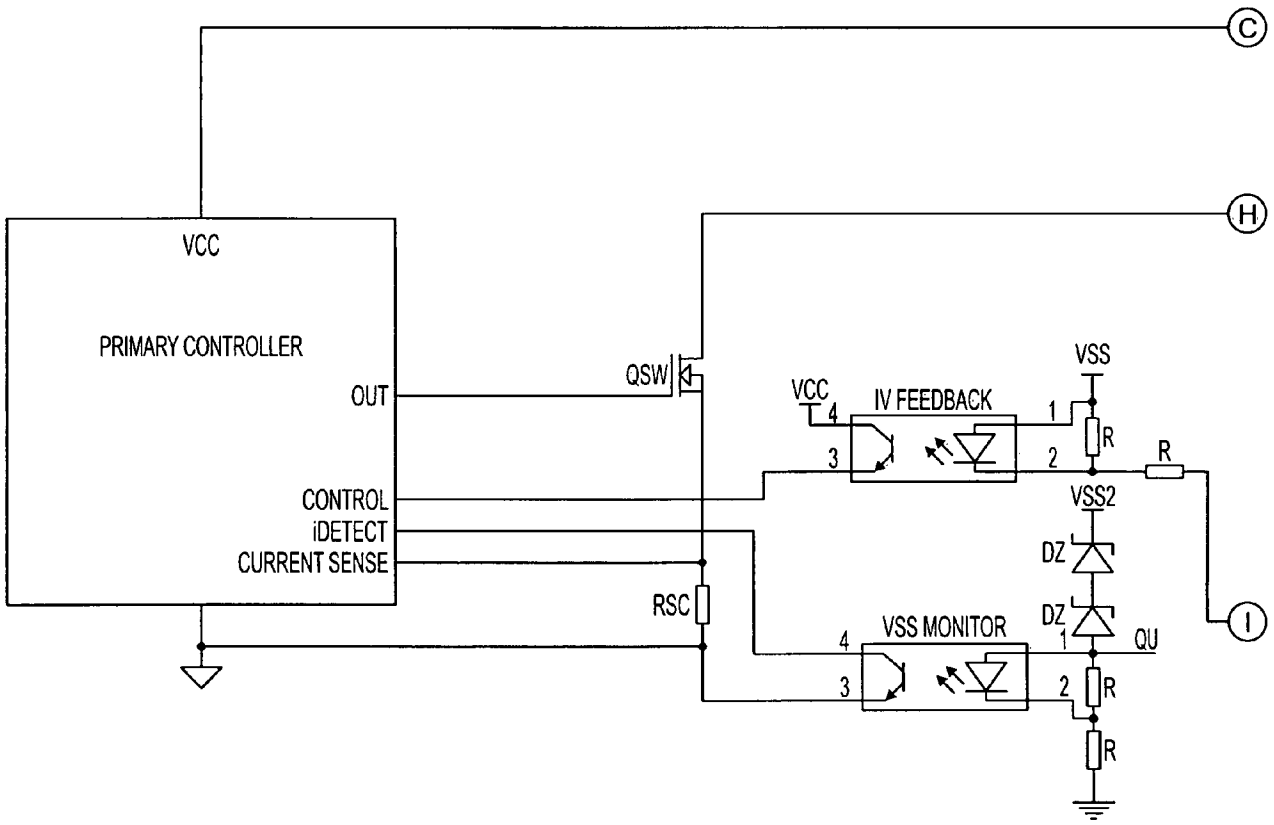
FIG. 4 is another circuit diagram of an auxiliary portion of the circuit.

A universal control section 21, FIG. 2 is independent circuitry that can be added to almost any type of electronic LED driver regardless of topologies used. The universal control section 21 provides additional forward phase or reverse phase dimming functions with minor modifications to original driver circuit or topology. The universal control section 21 also allows normal non dimming operation when connected directly to the mains. The present invention can be built with an additional daughter board that sits external to an existing driver, an application specific integrated IC (ASIC), etc. The universal control section 21 is a supplemental circuit that can be removed without affecting original circuit performance if such function is not required, the circuit can be made on a board that is tool free pluggable for modularized configuration.

Figure 6:
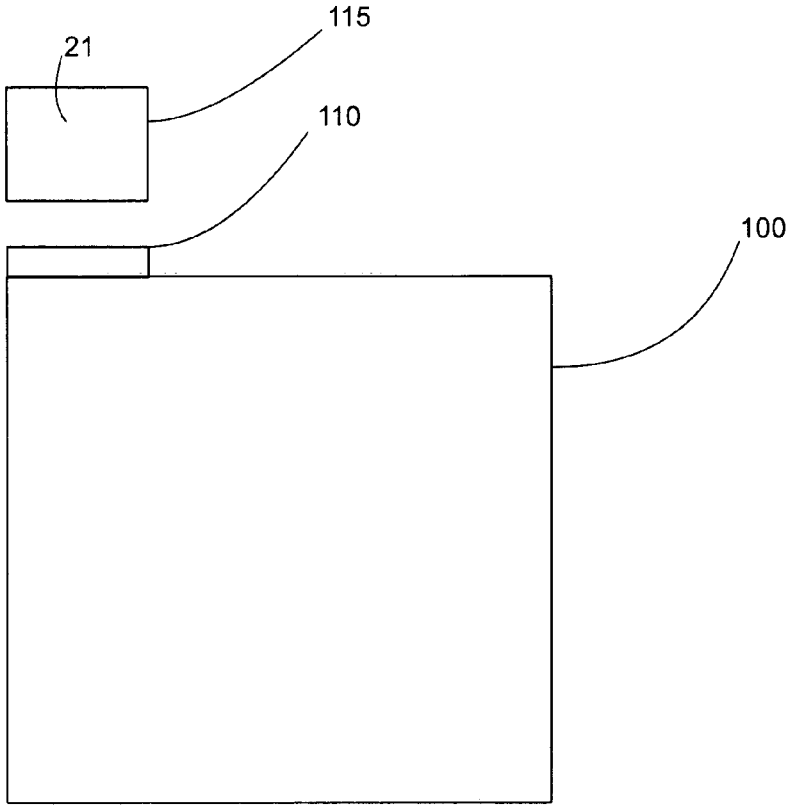
FIG. 6 is a diagram of the pluggable board.

The universal control section 21 can be put on a pluggable board 100 can be inserted into a socket 110 on an electronic LED driver during assembly or field service. Pluggable board 100 is preferably a hot pluggable board. FIG. 6 shows that the pluggable daughter card 115 can have the universal control section 21 which can be plugged to the circuit by a socket 110.

The universal control section 21 provides universal operation using either a "Triac" forward phase cut dimmer or "ELV" reverse phase cut dimmer the full circuit is implemented. If only "ELV" dimming is desired some components can be removed from the daughter board.

The circuit operation begins once an AC signal is present. The universal control section 21 has subcircuits.

Figure 1:
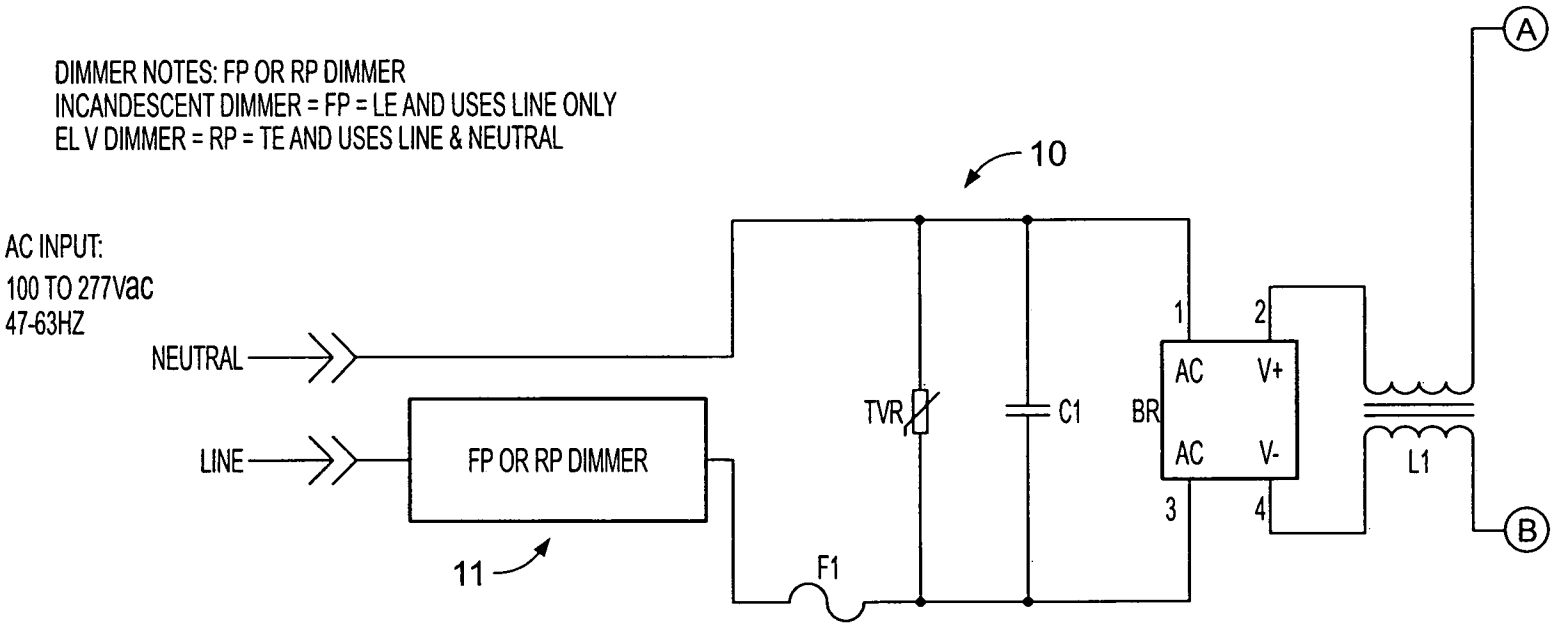
FIG. 1 is a circuit diagram of the AC Filter and Conversion Circuit of the present invention.

At the AC filter and conversion circuit 10, FIG. 1 a full wave bridge rectifier standard for electronic power supplies provides the initial signal for PWM processing and the necessary start-up voltages VCC for primary controller power and VCC3 for dimmer latch and hold circuitry power.

At the VCC3 startup and a low conduction period circuit 24, VCC3 is initially supplied via DZA1 and assures proper operation of the latch and hold circuitry during start-up and during low conduction periods when normal VCCX is not available. At the same time VCC is initially supplied via circuit containing DZA2 which assures proper operation of the primary controller during start-up and during low conduction periods when normal VCCX is not available.

VCC startup and low conduction period source circuit 26 has the analogous function of the VCC3 startup and a low conduction period circuit 24.

At the CC hold current circuit 22, the "CC Hold Current" portion of the circuit provides a hold current for the dimmer at low conduction periods. This prevents pulsing which would result in a flicker at the light. This hold current is adjusted to 60 mA typical and handles almost every type Incandescent or Magnetic low voltage forward phase dimmer available. This hold current can be easily adjusted via RB2 value. (RB0 is minimized to reduce losses so normal adjustment should be done via RB2)

At the latch circuit 23, the "Latch" portion of the circuit provides a current draw latch on once the Triac fires and maintains operation until the next zero crossing when the whole cycle repeats itself. If at low conduction periods then the "CC Hold Current" circuit will hold the current as a predetermined minimum to allow proper operation of the Triac based dimmer.

The PWM synchronize dimming circuit 25 provides a PWM signal dependent on the conduction period of the Dimmer in real time. This signal is then used to provide CCR (Constant Current Reduction) on the secondary thus dimming the LED loads attached. The signal can be sent as a square wave.

During normal operation between phase cut's, at high conduction periods or when no dimmer is being used in the circuit VCC3 & VCC are supplied from the main switching circuitry. This increases efficiency.

For ELV dimming only circuit can be simplified if refined for –TE=Trailing Edge=Reverse Phase=ELV dimmers only. The –TE circuit is greatly simplified and eliminates RB1, QB1, RB0, RB2, QB2, QB3, RB3, QB4, RB4, RB5, CB1, DB2, RB6, and QB5 as they are not required for reverse phase ELV dimmers.

Figure 5:
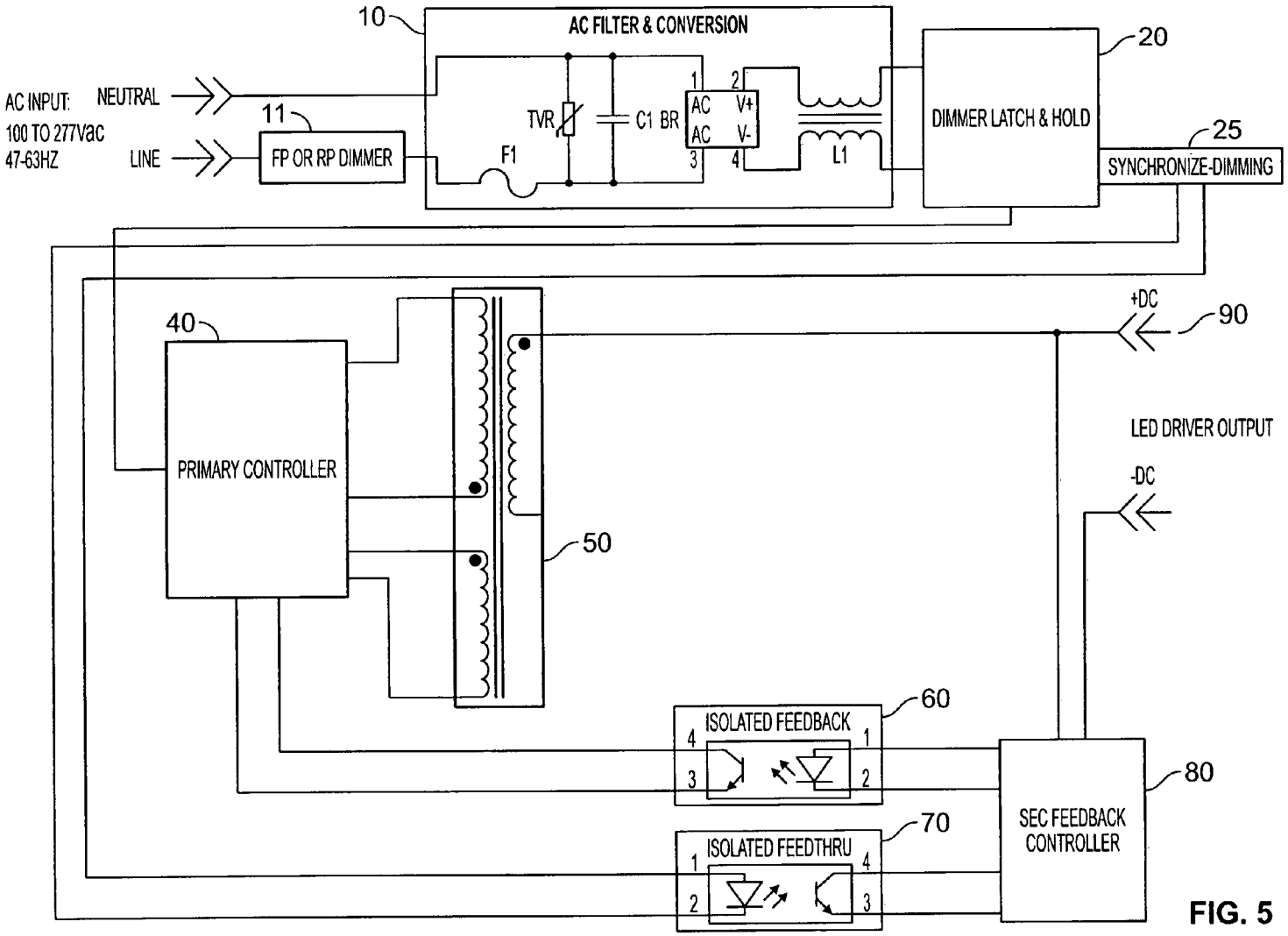
FIG. 5 is a block diagram of the present invention.

The primary controller 40, FIG. 5 can be formed as an IC chip. The transformer 50 is preferred. Isolated feedback 60 and isolated feed through 70 may provide isolation for the SEC feedback controller 80, FIG. 5. LED driver output 90 is connected to LED elements.

VCC3 Normal run 15V circuit 27 can optionally be a part of the universal control section 21, but can also be excluded from the universal control section 21 and not put on the daughter board.

The invention claimed is:

1. A supplemental dimming circuit for an electronic led driver comprising a universal control section having:

a. a VCC3 startup and low conduction period circuit for providing a current during start-up and during low conduction periods;

b. a CC hold current circuit for providing a hold current for the dimmer at low conduction periods;

c. a latch circuit for providing a current draw latch on;

d. a PWM synchronized dimming circuit for providing a PWM signal dependent on the conduction period of the dimmer in real time.

2. The supplemental dimming circuit for an electronic led driver comprising a universal control section of claim 1, further comprising a socket and a plug, wherein the universal control section is on a daughter board that is pluggable to the socket.

3. The supplemental dimming circuit for an electronic led driver comprising a universal control section of claim 1, wherein the VCC3 startup and low conduction period circuit creates a low AC voltage dummy load, which is a resistive load.

4. The supplemental dimming circuit for an electronic led driver comprising a universal control section of claim 1, wherein the CC hold current circuit creates a low AC current dummy load which is a constant current load.

5. A supplemental dimming circuit for an electronic led driver comprising a universal control section of claim 1, further comprising a VCC startup and low conduction period source circuit.

6. The supplemental dimming circuit for an electronic led driver comprising a universal control section of claim 5, further comprising a socket and a plug, wherein the universal control section is on a daughter board that is pluggable to the socket.

7. The supplemental dimming circuit for an electronic led driver comprising a universal control section of claim 5, wherein the VCC3 startup and low conduction period circuit creates a low AC voltage dummy load, which is a resistive load.

8. The supplemental dimming circuit for an electronic led driver comprising a universal control section of claim 5, wherein the CC hold current circuit creates a low AC current dummy load which is a constant current load.

9. The supplemental dimming circuit for an electronic led driver comprising a universal control section of claim 1, further comprising a VCC3 Normal run 15V circuit.

10. The supplemental dimming circuit for an electronic led driver comprising a universal control section of claim 9, further comprising a socket and a plug, wherein the universal control section is on a daughter board that is pluggable to the socket.

11. The supplemental dimming circuit for an electronic led driver comprising a universal control section of claim 9, wherein the VCC3 startup and low conduction period circuit creates a low AC voltage dummy load, which is a resistive load.

12. The supplemental dimming circuit for an electronic led driver comprising a universal control section of claim 9, wherein the CC hold current circuit creates a low AC current dummy load which is a constant current load.

13. A supplemental dimming circuit for an electronic led driver comprising a universal control section of claim 9, further comprising a VCC startup and low conduction period source circuit.

14. The supplemental dimming circuit for an electronic led driver comprising a universal control section of claim 13, further comprising a socket and a plug, wherein the universal control section is on a daughter board that is pluggable to the socket.

15. The supplemental dimming circuit for an electronic led driver comprising a universal control section of claim 13, wherein the VCC3 startup and low conduction period circuit creates a low AC voltage dummy load, which is a resistive load.

16. The supplemental dimming circuit for an electronic led driver comprising a universal control section of claim 13, wherein the CC hold current circuit creates a low AC current dummy load which is a constant current load.

* * * * *